US010344926B2

(12) United States Patent
Moon et al.

(10) Patent No.: US 10,344,926 B2
(45) Date of Patent: Jul. 9, 2019

(54) MODULAR LED RETROFIT LAMP SYSTEM

(71) Applicants: Brian Moon, Woodbridge, VA (US); John Luhrs, Marietta, GA (US)

(72) Inventors: Brian Moon, Woodbridge, VA (US); John Luhrs, Marietta, GA (US); Thomas Kennedy, Bristow, VA (US)

(73) Assignees: Brian Moon, Woodbridge, VA (US); John Luhrs, Marietta, GA (US)

( * ) Notice: Subject to any disclaimer, the term of this patent is extended or adjusted under 35 U.S.C. 154(b) by 0 days.

(21) Appl. No.: 16/008,389

(22) Filed: Jun. 14, 2018

(65) Prior Publication Data

US 2018/0299083 A1 Oct. 18, 2018

Related U.S. Application Data

(63) Continuation of application No. 15/140,364, filed on Apr. 27, 2016, now Pat. No. 10,036,519.
(Continued)

(51) Int. Cl.

| | |
|---|---|
| ***F21K 9/68*** | (2016.01) |
| ***F21S 8/02*** | (2006.01) |
| ***F21K 9/233*** | (2016.01) |
| *F21V 23/00* | (2015.01) |
| *F21V 7/00* | (2006.01) |
| *F21V 29/67* | (2015.01) |
| *F21V 29/74* | (2015.01) |
| *F21Y 115/10* | (2016.01) |

(52) U.S. Cl.
CPC ..... *F21S 8/02* (2013.01); *F21K 9/233* (2016.08); *F21K 9/68* (2016.08); *F21V 7/0066* (2013.01); *F21V 23/008* (2013.01); *F21V 29/67* (2015.01); *F21V 29/74* (2015.01); *F21Y 2115/10* (2016.08)

(58) Field of Classification Search
CPC ..... F21Y 2103/33; F21S 8/026; F21S 8/02; F21S 8/04; F21V 29/70; F21V 29/004; F21V 21/04; F21V 23/026
USPC ..... 362/364, 294, 373
See application file for complete search history.

(56) References Cited

U.S. PATENT DOCUMENTS 5,971,564 A 10/1999 Wang
7,125,159 B2 10/2006 Hirsch et al.
(Continued)

OTHER PUBLICATIONS

"Setting the standard in LED modules Philips Fortirno LED High Brightness Module", Philips website: http://wwwl.futureelectronics.com/doc/PHILIPS%20LIGHTING/929000636503.pdf.

*Primary Examiner* — William J Carter
(74) *Attorney, Agent, or Firm* — Thomas Horstemeyer, LLP

(57) ABSTRACT

The modular LED retrofit lamp system includes a high-power LED light engine, together with an integrated optics mount, an integrated yet serviceable LED dimmable driver, and a point of attachment on the center area of the engine for mounting the LED engine. Different mounts for the engine can include, but are not limited to, PAR56, PAR46, PAR64, PAR38, Mini Candelabra, Intermediate Screw Base, Mogul Screwbase, and Fresnel-based Theatrical Fixtures. One LED light engine can replace a wide range of tungsten lamps ranging up to 500 watt equivalents in output performance, as well as dimming performance. Additional brackets and lamp sockets easily retrofit into an existing lighting fixture, while dimming capabilities are retained.

20 Claims, 8 Drawing Sheets

Related U.S. Application Data

(60) Provisional application No. 62/153,551, filed on Apr. 28, 2015.

(56) References Cited

U.S. PATENT DOCUMENTS

| | | | | |
|---|---|---|---|---|
| 7,862,214 | B2 * | 1/2011 | Trott | F21S 8/026 362/365 |
| 7,905,626 | B2 | 3/2011 | Shantha et al. | |
| 8,128,263 | B2 | 3/2012 | Higuchi et al. | |
| 8,262,258 | B2 | 9/2012 | VanderSluis et al. | |
| 8,485,713 | B2 | 7/2013 | Atalay | |
| 8,668,374 | B2 | 3/2014 | Yoo et al. | |
| 8,696,158 | B2 * | 4/2014 | Santiago | F21S 8/026 362/249.02 |
| 8,721,134 | B1 * | 5/2014 | Kliegl | F21V 21/30 362/287 |
| 8,770,799 | B2 | 7/2014 | Becker et al. | |
| 8,770,806 | B2 | 7/2014 | Koo et al. | |
| 9,134,019 | B2 * | 9/2015 | Thomas | F21V 15/01 |
| 9,239,153 | B2 | 1/2016 | Goodman et al. | |
| 2005/0231964 | A1 | 10/2005 | Tufano, Sr. et al. | |
| 2009/0290343 | A1 | 11/2009 | Brown et al. | |
| 2011/0222291 | A1 * | 9/2011 | Peng | F21V 15/01 362/294 |

* cited by examiner

MODULAR LED RETROFIT LAMP SYSTEM

CROSS-REFERENCE TO RELATED APPLICATION

This application is a continuation of U.S. application Ser. No. 15/140,364, filed Apr. 27, 2016 which claims the benefit of U.S. Provisional Patent Application Ser. No. 62/153,551, filed Apr. 28, 2015, both of which are entirely incorporated herein by reference.

BACKGROUND OF THE INVENTION

Field of the Invention

The present invention relates to lighting systems, and more particularly, to a modular LED retrofit lamp system.

Description of the Related Art

Light emitting diode (LED) lamps are only good for the intended socket they are designed for. Tungsten lamps have this same issue. A PAR56 lamp would only be able to function in a fixture that was designed to be used with that particular lamp. LED lamps are the same. A PAR38 LED Lamp is only designed to go into a PAR38 fixture, even though it could go into a standard lamp, as does an A19 lamp. High-power LED lamps are designed currently to go into a single lamp socket without having the means to fit into an existing lamp fixture. A complete redesign of the lamp itself would be required.

Thus, a modular LED retrofit lamp system solving the aforementioned problems is desired.

SUMMARY OF THE INVENTION

The modular LED retrofit lamp system includes a basic high-power LED light engine, together with an integrated optics mount, an integrated yet serviceable LED dimmable driver, and a point of attachment on the center area of the engine for mounting the LED engine. Different mounts for the engine can include, but are not limited to, PAR56, PAR46, PAR64, PAR38, Mini Candelabra, Intermediate Screw Base, Mogul Screwbase, and Fresnel-based Theatrical Fixtures. One LED engine can replace a wide range of tungsten lamps ranging up to 500 watt equivalents in output performance, as well as dimming performance. Additional brackets and lamp sockets easily retrofit into an existing lighting fixture, while dimming capabilities are retained.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
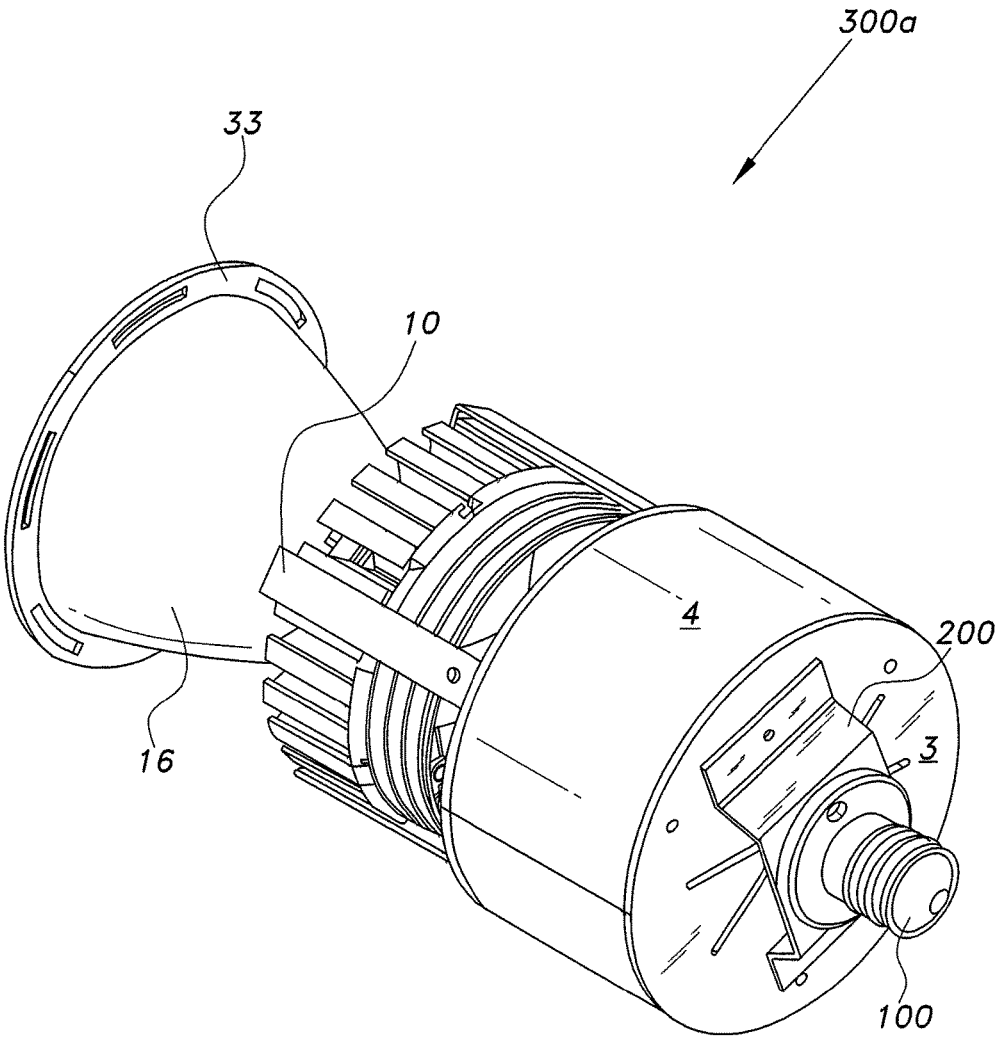
FIG. 1 is a perspective view of a modular LED retrofit lamp system with a screw-base according to the present invention, shown equipped with a screw-base.
Figure 2:
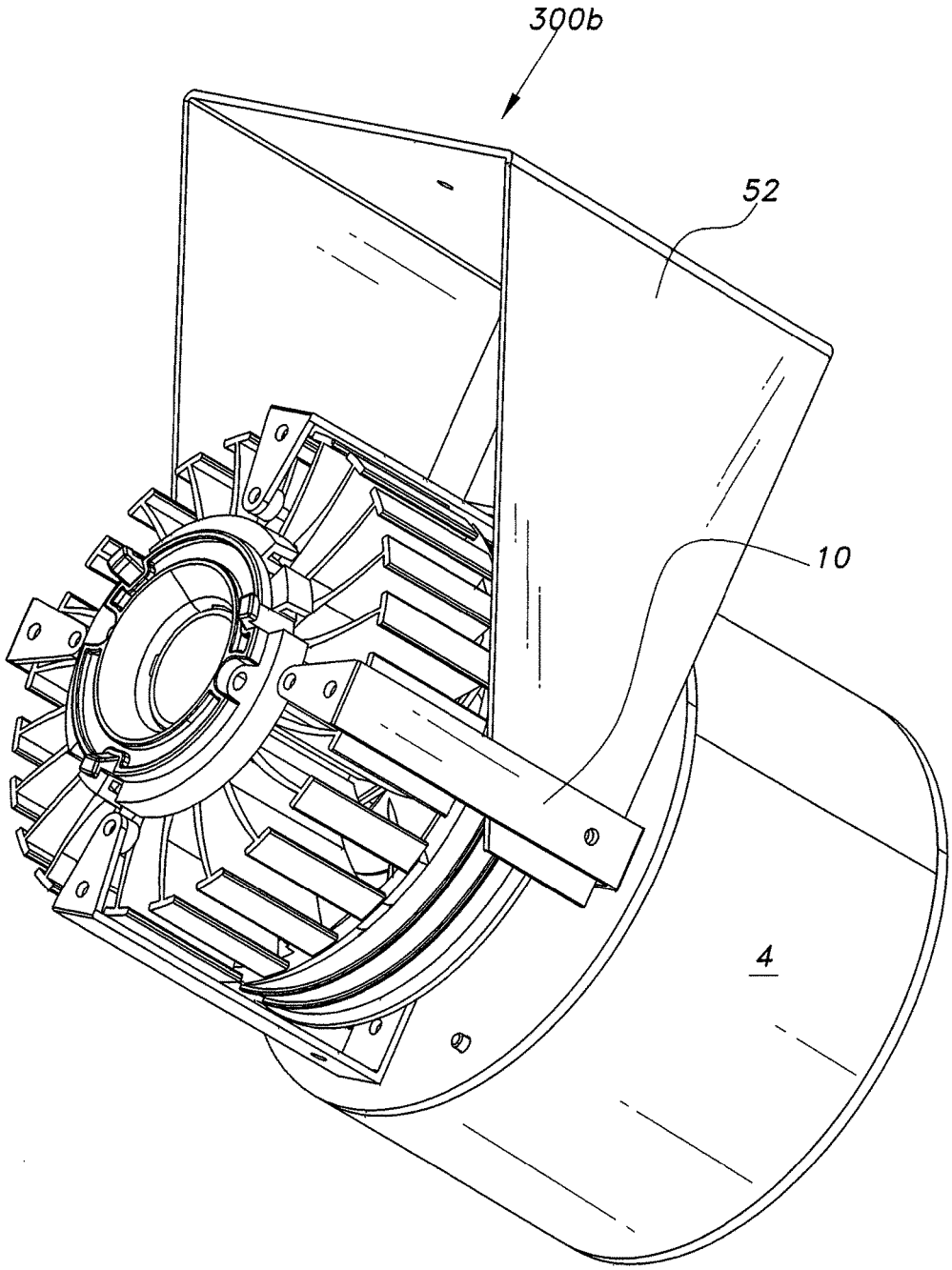
FIG. 2 is a perspective view of a modular LED retrofit lamp system according to the present invention, shown equipped with a Fresnel mount.
Figure 3:
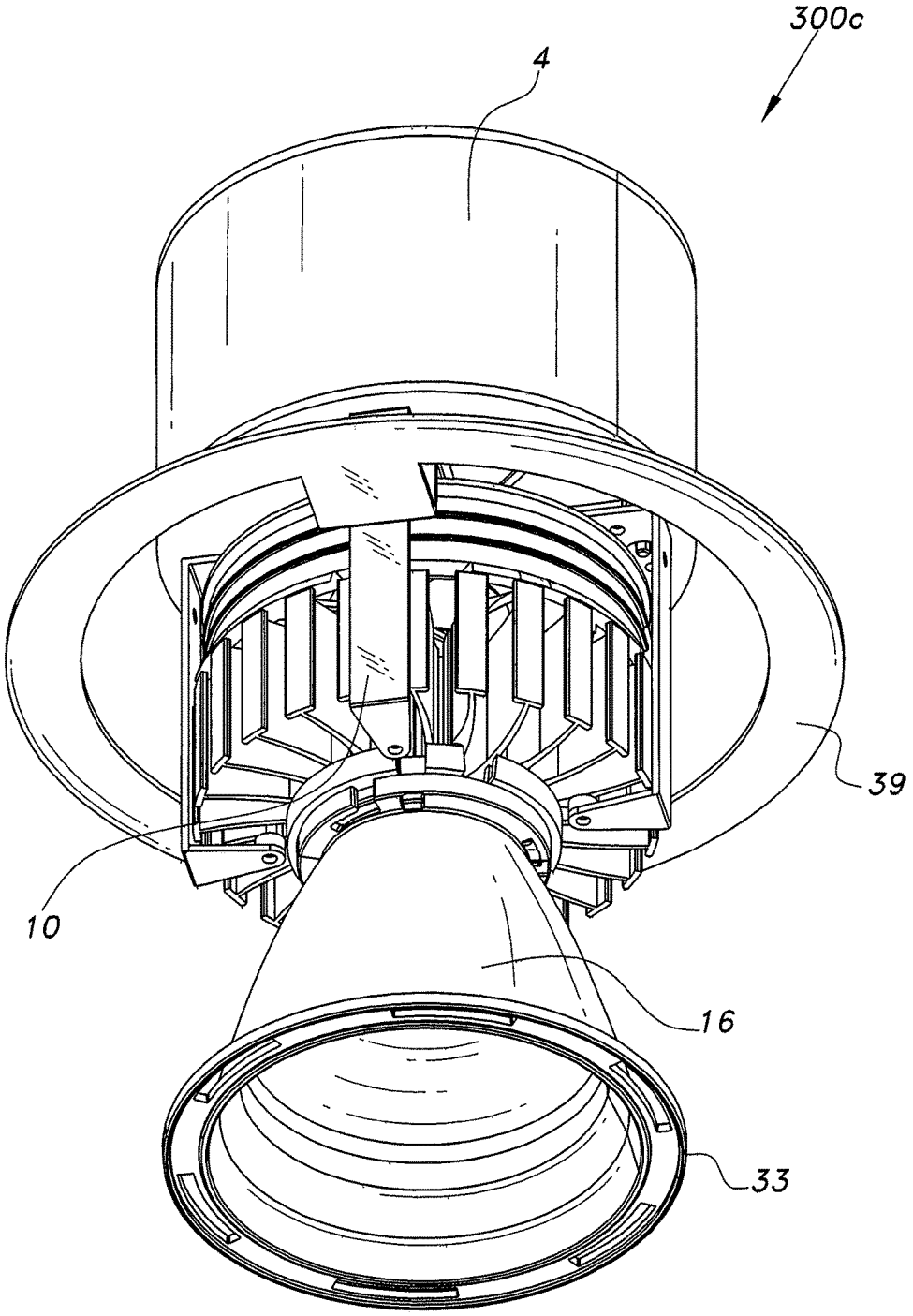
FIG. 3 is a perspective view of a modular LED retrofit lamp system according to the present invention, shown equipped with a PAR replacement ring.

Referring to FIGS. 1-3, the modular LED retrofit lamp system includes a basic high-power LED light engine, together with an integrated optics mount, an integrated yet serviceable LED dimmable driver, and a point of attachment on the center area of the engine for mounting the LED engine. Different mounts for the engine can include, but are not limited to, PAR56, PAR46, PAR64, PAR38, Mini Candelabra, Intermediate Screw Base, Mogul Screw base, and Fresnel-based Theatrical Fixtures. One LED light engine would be able to replace a wide range of tungsten lamps ranging up to 500 watt equivalents in output performance (or more generally, lamps in the range of 50 watts to 1,000 watts), as well as dimming performance. The LED light engine of the present modular LED retrofit lamp system is designed with the intent of adding additional brackets and lamp sockets in order to easily retrofit into an existing lighting fixture and still have the capabilities of dimming, like its tungsten predecessor, on a long range of commercial-grade dimmers.

Referring now to FIGS. 1-5, the base LED light engine 300*d* comprises custom and standard components. These components include, but are not limited to, the following: an LED driver that is modular and phase-dimmable; an actively cooled heat sink 12*a*, 12*b*, 12*c* in order to keep the driver cool and well-ventilated; and a high-power single point source emulated LED chip 14 mounted to the heat sink/fan combination 12*a*, 12*b*, 12*c*, being held together by a plastic mount, which also allows the optics to easily attach or detached, This "LED Engine", comprising the heat sink/fan 12*a*, 12*b*, 12*c*, LED, LED Holder and optics, is attached to the driver enclosure 4 via two custom brackets 10, 11 with side-mount holes. The holes in these brackets allow for different types of mounting brackets and adapters to attach to in order to hold the light engine in its place inside the existing lighting fixture it is being adapted too. In terms of a PAR56 or PAR64 Fixture, a trim ring 39 (shown in FIG. 3) having flange openings designed to bolt into the side of custom arm brackets allows the engine to fit perfectly into the existing fixture. In terms of a Fresnel lamp replacement, the setup may be similar to the PAR56 and 64 by having the bracket furnished to provide a Fresnel mount 52 for the base LED light engine with driver. For a screw-in base lamp, there are holes on top of the driver case to allow for a medium base mate screw base 100 to be installed. Numerous standard lamp base adapters can be attached to the medium screw base male connector (E26/E27).

Figure 4:
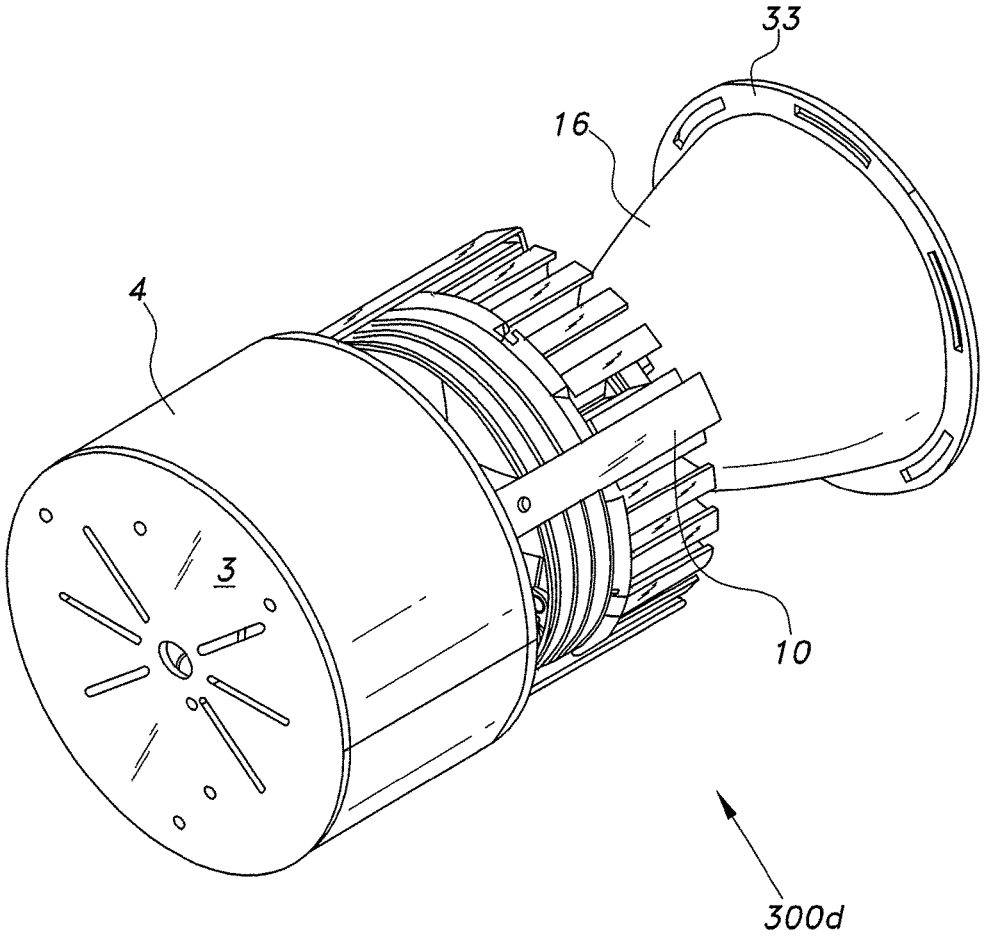
FIG. 4 is a perspective view of a modular LED retrofit lamp system according to the present invention, shown equipped with a base engine mount.
Figure 5:
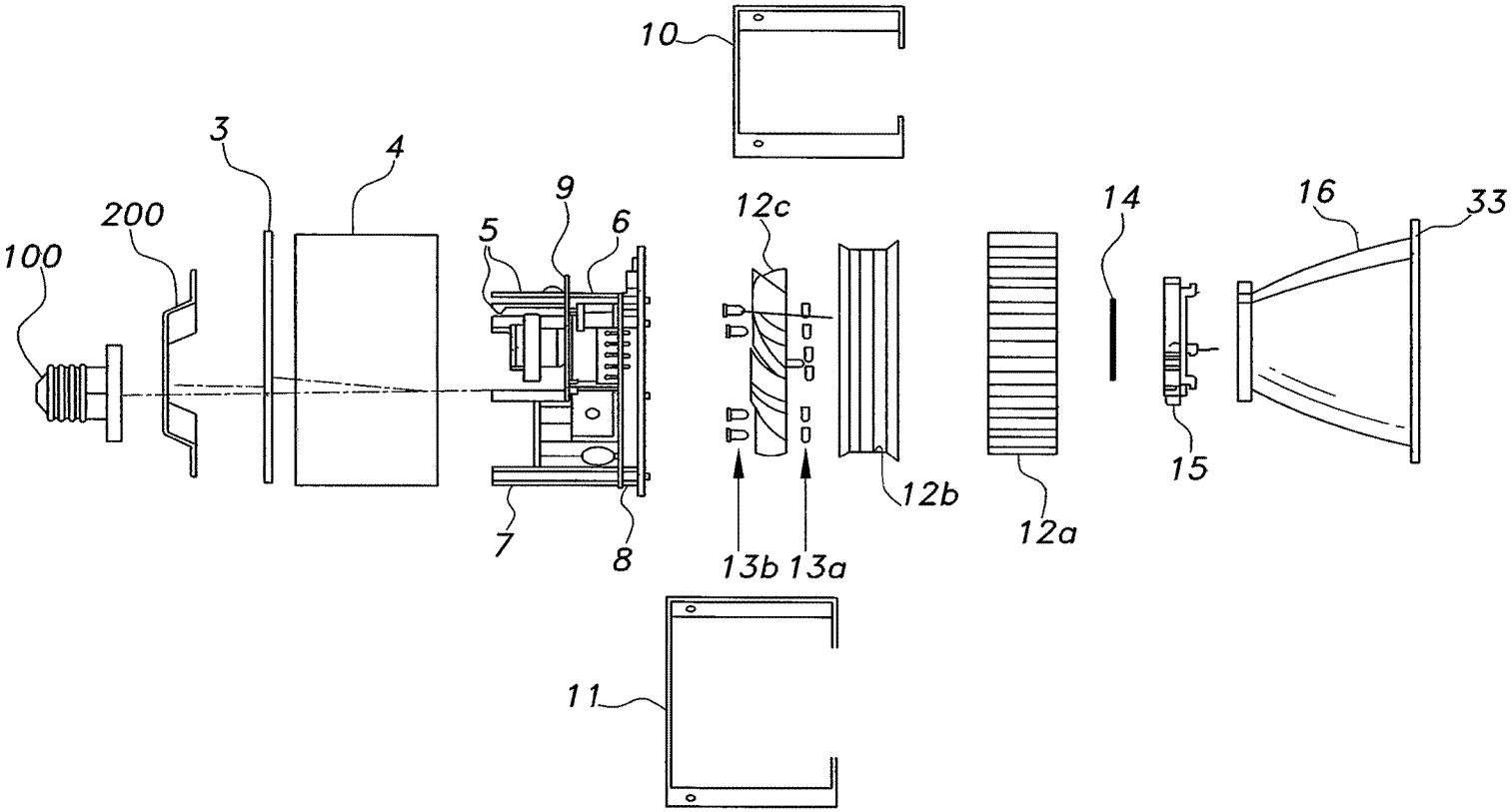
FIG. 5 is an exploded view of an exemplary modular LED retrofit lamp system according to the present invention.
Figure 6:
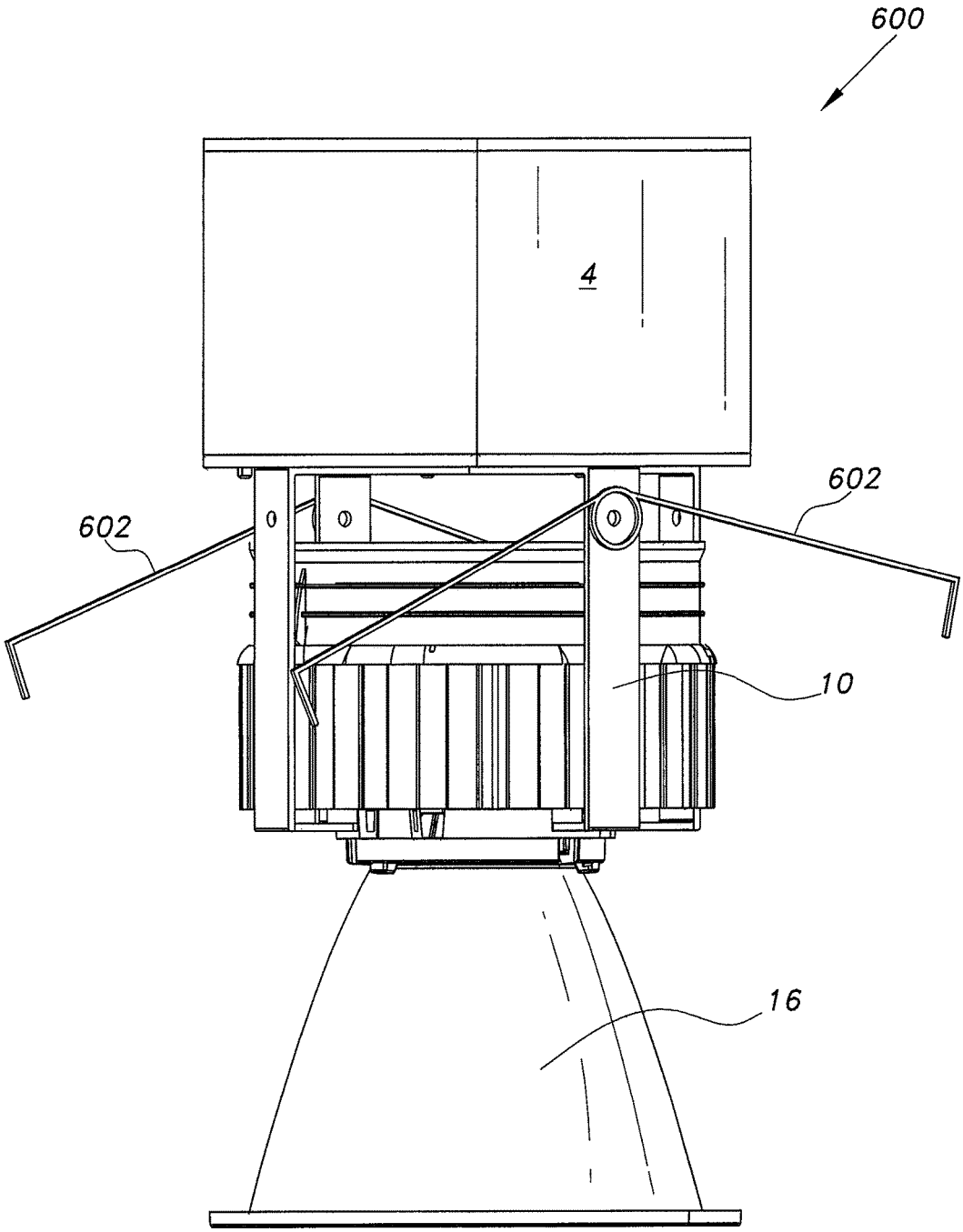
FIG. 6 is a perspective view of a modular LED retrofit lamp system according to the present invention, shown equipped with a spring mount.

In a preferred embodiment, shown in FIG. 5, a modular annular heat sink assembly comprises heat sink fins 12*a*, which are disposed over a plastic nylon spacer 12*b*. The assembly is retained by a driver thermal protection ring 12*c* attached via fasteners 13*b*, which are secured by nuts 13*a*. The modular annular heat sink assembly 12*a*, 12*b*, 12*c* is in coaxial arrangement with an annular shaped optics holder 15 that functions as a holder for LED optics 14, the optics holder 15 attaching to a substantially conic section-shaped LED engine reflector 16. The LED engine reflector 16 has a reflector attachment flange 33 disposed around a largest circumference of the LED engine reflector 16. The conical reflector 16 is exemplary, and it will be understood that the optics may use PMMA (poly (methyl methacrylate))-based, silicone-based, or TIR (total internal reflection)-based optics, or aluminum, glass, or anti-reflective glass-based optics. A high-power single' point source emulated LED chip 14 is disposed between the heat sink assembly 12*a*, 12*b*, and 12*c* and the optics holder 15, the high-power single point source emulated LED chip 14 being recessed into a center opening of the heat sink fin portion 12*a*. Posterior to the heat sink and reflector assembly are two C-shaped custom mounting brackets 10 and 11. The C-shaped custom mounting brackets 10 and 11 have overhanging open portions of the C shape that attach to anterior-most portion 12*a* of the heat sink assembly and posterior-most portion 12*e* of the heat sink assembly. Bottom closed portions of mounting brackets 10 and 11 are adaptable to fit a variety of lamp fixture housings, as the holes in these brackets allow for different types of mounting brackets and adapters to attach to in order to hold the light engine in its place inside the existing lighting fixture it is being adapted to. In the exemplary modular LED retrofit lamp system shown in FIG. 5, bottom closed portions of mounting brackets 10 and 11 are attached to a custom dimensioned tubular can 4 which houses an LED driver attached to a custom plate 8, which, in turn, is adapted for the attachment of the brackets 10 and 11 thereto. The LED driver comprises modular circuit boards 5, 6, 7, and 9, and may include LED dimmer circuitry, and the like. The LED driver is in operable communication with the LED light engine 14. A posterior plate 3 attaches to posterior portion of the tubular can 4 to completely enclose the LED driver assembly. An Edison mount flange 200 attaches to an exposed portion of the custom plate 3, the Edison mount flange 200 retaining an Edison mount threaded electrical contact adapter 100. The Edison mount threaded adapter 100 is in operable communication with the LED driver circuitry 5, 6, 7, and 9. A perspective view of the Edison mount embodiment 300*a* is shown in FIG. 1. As shown in FIG. 2, in the Fresnel mount embodiment 300*b*, a Fresnel mount is attached to the brackets 10 and 11 in lieu of the Edison mount assembly. As shown in FIG. 3, an oversized annular mounting ring 39 is attached to the brackets 10 and 11 to provide a recess lighting configuration 300*c* in lieu of the Edison mount assembly. The oversized annular mounting ring 39 is approximately one inch larger in diameter than the can 4. As shown in FIG. 4, the base engine 300*d* includes the can 4 without any particular mounting option installed. A spring mount embodiment 600, shown in FIG. 6, includes dual elongate armed spring mounts 602 affixed to attachment points on opposing sides of one of the C-shaped mounting brackets 10, 11 proximate the tubular can 4 of the modular LED lamp fixture.

Figure 7:
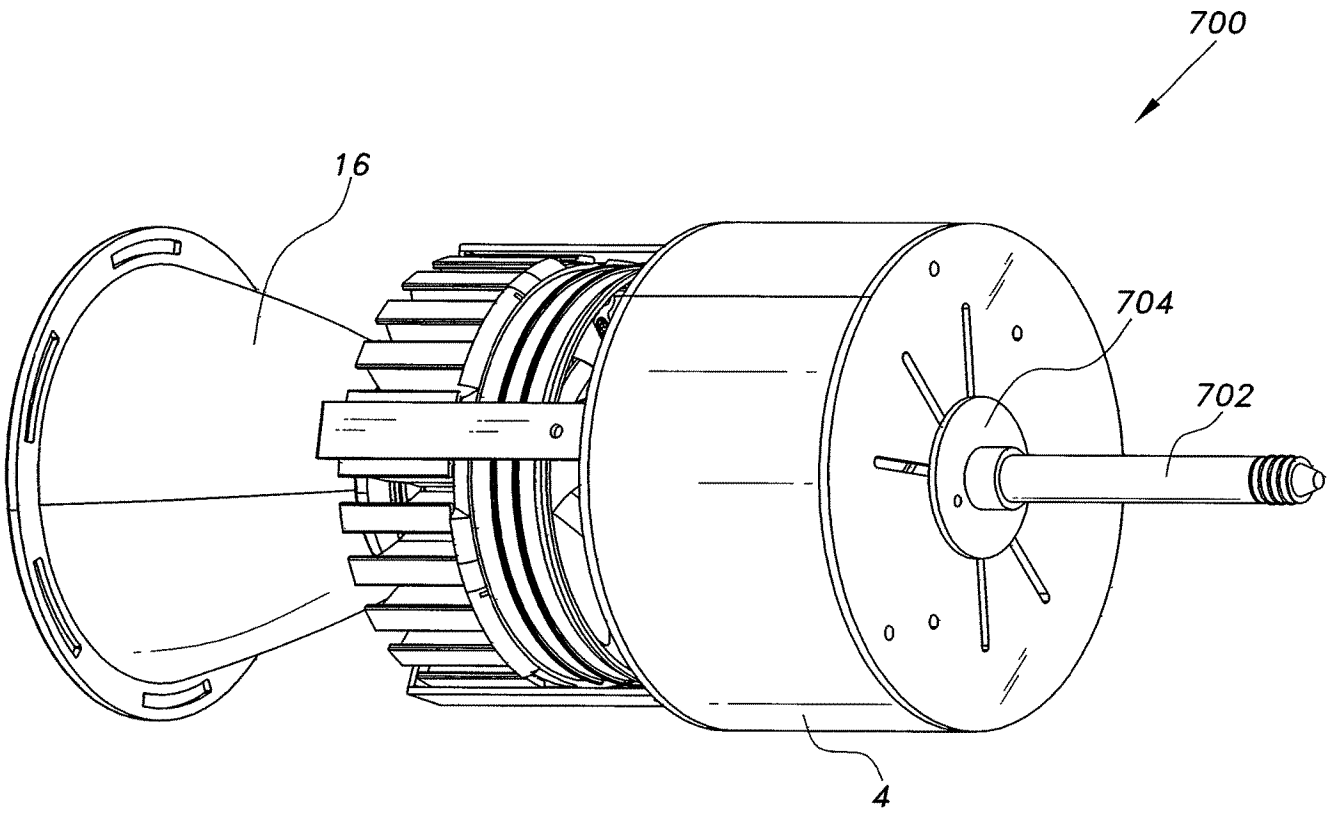
FIG. 7 is a perspective view of a modular LED retrofit lamp system according to the present invention, shown equipped with an Ell mini-candelabra mount.

A mini-candelabra mount embodiment 700, shown in FIG. 7, includes an elongate, cylindrical mini candelabra screw mount electrical contact 702 that extends into a circular planar member 704, which attaches to a posterior' portion of the tubular can 4, the mini candelabra screw mount electrical contact 702 being in operable communication with the LED driver.

Figure 8:
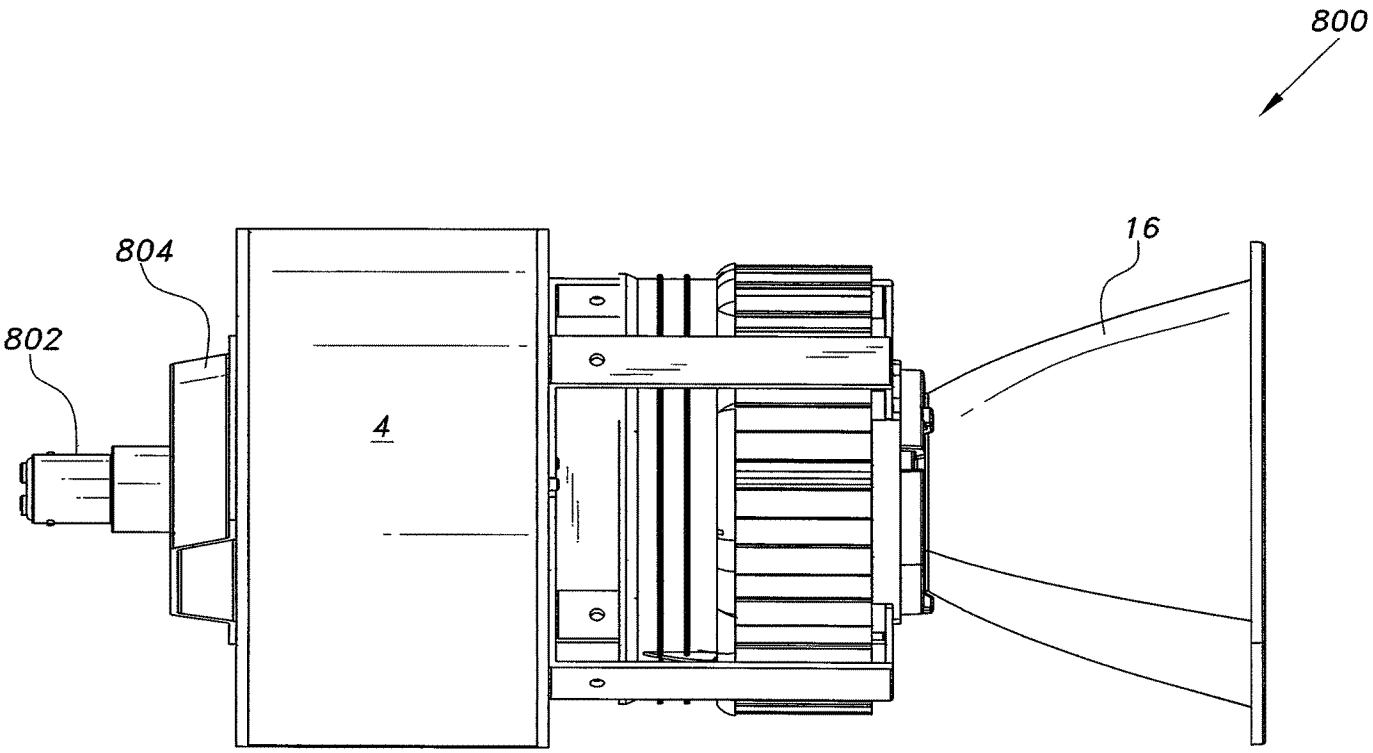
FIG. 8 is a perspective view of a modular LED retrofit lamp system according to the present invention, shown equipped with a BA15D mount.

A BA15D mount embodiment 800, shown in FIG. 8, includes a BA15D plug-in mount electrical contact 802 that attaches to a BA15D mounting flange 804, the BA15D mounting flange, in turn, being attached to a posterior portion of the can 4 to form the BA15D mount embodiment 800, the BA15D plug-in mount electrical contact 802 being in operable communication with the LED driver.

A method of making the present modular LED lamp fixture may include the mounting of the LED chip 14 to the heat sink assembly 12*a*-12*c* with thermal compound disposed between the LED and aluminum heat sink/fan assembly 12*a*, 12*c* attached via plastic nylon spacer 12*b*. Via use of the optics holder 15 that holds the optics, screws 13*b* are placed into the heat sink and secured by nuts 13*a*, this configuration holding the LED 14 firmly onto the heat sink 12*a*, 12*c*, as well as holding the removable optics. Next, the aluminum arm brackets 10, 11 are mounted to the heat sink/fan 12*a*, 12*c*. The brackets 10, 11 allow for the driver enclosure 4 to be mounted to the heat sink 12*a*, 12*c*. Once the brackets 10, 11 are installed, the plastic nylon spacer 12*b* is disposed between the driver thermal protection 12*c* and the LED thermal protection 12*a*, the plastic nylon spacer 12*b* acting as a thermal separator. PCB stand-offs are mounted on the anterior plate 8 of the driver enclosure. Once the PCB stand-offs are attached, the anterior plate 8 is mounted to the arm brackets 10, 11 using screws and nuts. When the anterior plate 8 is mounted, the LED driver is attached using a series of stand-offs to stack the fan electronics 9 from the LED electronics 6. Once the driver is mounted, the tube piece (can 4) is slid over the assembly to cover and protect the electronics, the posterior plate 3 being mounted using fasteners disposed in the existing top holes of the driver PCB, thereby acting as a sandwiching assembly that holds components of the present modular LED retrofit lamp system in. place. Once the base engine 300*d* is assembled, the custom metal brackets and wiring are attached to the fixture, thereby enabling the fixture to receive power. The LED and fan on the heat sink are wired back to the LED driver electronics, where it will be able to control the LED 14, as well as the fan, while it is being dimmed by a standard forward phase/reverse phase dimmer.

A method of using the present modular LED retrofit lamp system may include, for example, using the base engine to determine the best way of attaching the LED light engine into an existing fixture. In terms of a screw-in base, i.e., Ell, E17, E12, E26, E27, E29, or the like, mount the Edison Male E26 base adapter to the top of the base engine. Depending on the depth of the socket to the reflector of the existing fixture, the depth of the bracket may be adjusted in order to have the lamp system remain inside of the fixture. Then, use an existing adapter to screw onto the lamp base and screw into the existing lamp socket. If doing any other adaptations, start with the base engine and attach means of mechanical attachment to the side of the mount arms, while using bare wires coming from the rear of the fixture to either attach a lamp socket adapter or to hard-wire the unit directly into the existing fixture.

It is to be understood that the present invention is not limited to the embodiments described above, but encompasses any and all embodiments within the scope of the following claims.

We claim:

1. A lamp system, comprising:

an LED light source;

an LED driver in operable communication with the LED light source;

a light reflector;

an optics holder, the optics holder being disposed in coaxial alignment with and attached to the light reflector;

a heat sink assembly, the LED driver being coupled to a posterior portion of the heat sink assembly, the LED light source being coupled to an anterior portion of the heat sink assembly, and the heat sink assembly being in coaxial arrangement with and attached to the optics holder;

a housing comprising an anterior section and a posterior section, the LED driver being disposed within the housing, the anterior section comprising an anterior plate of the housing, and the posterior section of the housing comprising a posterior plate; and at least one mounting bracket comprising a first portion directly attached to the anterior portion of the heat sink assembly, a second portion directly attached to the anterior plate of the housing, and a connection between the first portion and the second portion that extends perpendicular to the first portion and the second portion.

2. The lamp system of claim 1, further comprising:

a flange attached to an exposed portion of the posterior plate; and an electrical contact attached to and secured by the flange, the electrical contact being in operable communication with the LED driver.

3. The lamp system of claim 1, further comprising:

a circular planar member attached to an exposed portion of the posterior plate of the housing; and a screw mount electrical contact attached to the circular planar member, the screw mount electrical contact being in operable communication with the LED driver.

4. The lamp system of claim 1, wherein the at least one mounting bracket comprises a mounting point on the connection between the first portion and the second portion.

5. The lamp system of claim 4, further comprising a Fresnel mount attached to the at least one mounting bracket via the mounting point, the Fresnel mount being disposed between the housing and the heat sink assembly.

6. The lamp system of claim 4, further comprising dual armed spring mounts affixed to opposing sides of the at least one mounting bracket via the mounting point.

7. The lamp system of claim 4, further comprising a ring component attached to the at least one mounting bracket, the ring component being attached between the heat sink assembly and the housing and in coaxial aliment with the heat sink assembly and the housing.

8. The lamp system of claim 1, wherein the LED light source is disposed within a recess of the anterior portion of the heat sink assembly.

9. The lamp system of claim 1, wherein the LED driver comprises phase dimmer circuitry.

10. The lamp system of claim 1, wherein the heat sink assembly comprises a driver thermal protection component, a LED thermal protection component, and a spacer, the spacer being disposed between the driver thermal protection component and the LED thermal protection component.

11. The lamp system of claim 1, further comprising an anterior plate attached to the LED driver, the anterior plate being substantially flush mounted to the anterior portion of the housing.

12. The lamp system of claim 1, wherein the light reflector has a small circumference end and a large circumference end, and the light reflector includes an attachment flange disposed around the large circumference end.

13. The lamp system of claim 1, wherein the lamp system is configured to be retrofitted with a plurality of different types of lighting fixtures.

14. A method, comprising:

identify an adapter component for attaching the lamp system of claim 1 to a lighting fixture;

attaching the adapter component to the lamp system; and attaching the lamp system to the lighting fixture.

15. The method of claim 14, wherein attaching the adapter component further comprises:

attaching the adapter component to an exposed side of the posterior plate; and electrically coupling an electrical contact of the adapter component to the LED driver.

16. The method of claim 14, wherein the at least one mounting bracket comprises a mounting point on the connection between the first portion and the second portion.

17. A light system, comprising:

an LED apparatus comprising:

an LED light source;

an LED driver in operable communication with the LED light source; and a heat sink assembly disposed between the LED light source and the LED driver;

a housing being attached to the LED apparatus via at least one mounting bracket, and the LED driver being disposed within the housing;

the at least one mounting bracket comprising a first portion directly attached to an anterior portion of the heat sink assembly, a second portion directly attached to an anterior plate of the housing, and a connection between the first portion and the second portion that extends perpendicular to the first portion and the second portion, wherein the anterior portion of the heat sink faces a projection direction of the LED light source; and wherein the light system is configured to retrofit into any one of a plurality of different lighting fixtures.

18. The light system of claim 17, further comprising:

a light reflector; and an optics holder coupled to the anterior portion of the heat sink assembly, the optics holder securing the LED light source within a recessed portion of the heat sink assembly, and the optics holder being disposed in coaxial alignment with and attached to the light reflector.

19. The light system of claim 17, further comprising:

a posterior plate mounted to a posterior opening of the housing;

an attachment component attached to an exposed portion of the posterior plate; and an electrical contact attached to and secured by the attachment component, the electrical contact being in operable communication with the LED driver.

20. The light system of claim 17, further comprising an additional component attached to the at least one mounting bracket via attachment points of the at least one bracket, the additional component comprising at least one of a Fresnel mount, a dual armed spring mount, or a mounting ring.

* * * * *